US008462978B2

(12) United States Patent
Milot et al.

(10) Patent No.: US 8,462,978 B2
(45) Date of Patent: Jun. 11, 2013

(54) LOUDSPEAKER DIAPHRAGM

(75) Inventors: Gilles Milot, Paris (FR); Claudia Gradia, Ruaudin (FR)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1626 days.

(21) Appl. No.: 11/123,968

(22) Filed: May 6, 2005

(65) Prior Publication Data

US 2005/0281433 A1 Dec. 22, 2005

(30) Foreign Application Priority Data

May 6, 2004 (EP) ..... 04291167

(51) Int. Cl.
*H04R 1/00* (2006.01)

(52) U.S. Cl.
USPC ..... 381/426; 381/423; 381/428

(58) Field of Classification Search
USPC ..... 381/423–432
See application file for complete search history.

(56) References Cited

U.S. PATENT DOCUMENTS

| | | | | |
|---|---|---|---|---|
| 4,410,768 | A | 10/1983 | Nakamura et al. | 179/115.5 R |
| 4,427,846 | A * | 1/1984 | Millward | 381/423 |
| 4,552,243 | A | 11/1985 | Melillo et al. | 181/169 |
| 5,283,027 | A | 2/1994 | Sakamoto et al. | 264/320 |
| 5,458,958 | A * | 10/1995 | Kanzaki et al. | 442/338 |
| 5,464,684 | A * | 11/1995 | Vogelsang et al. | 442/198 |
| 5,910,361 | A * | 6/1999 | Guevel et al. | 428/364 |
| 6,066,235 | A | 5/2000 | Scheinberg | 162/141 |
| 6,097,827 | A | 8/2000 | Yang | 381/375 |
| 7,311,174 | B2 * | 12/2007 | Hayakawa et al. | 181/169 |
| 7,443,998 | B2 * | 10/2008 | Hachiya | 381/426 |

FOREIGN PATENT DOCUMENTS

| | | |
|---|---|---|
| GB | 2105247 | 6/1982 |
| GB | 2322505 | 2/1998 |
| JP | 02170797 | 7/1990 |

* cited by examiner

*Primary Examiner* — Curtis Kuntz
*Assistant Examiner* — Ryan Robinson
(74) *Attorney, Agent, or Firm* — Brinks Hofer Gilson & Lione

(57) ABSTRACT

A loudspeaker diaphragm made by preparing a fabric from a hybrid yarn, wherein the hybrid yarn includes a matrix component and a reinforcement component. The matrix component may include a first material selected from a group consisting of a polyamide, a polyphenylene sulfide, and a polyetheretherketone, and the reinforcement component may include a second material selected from a group consisting of carbon and a para-aramid. The fabric may be introduced into a mold and molded to form a loudspeaker diaphragm. The fabric may then be heated to a temperature higher than the melting temperature of the polyamide or polyphenylene sulfide or polyetheretherketone, so that the polyamide or polyphenylene sulfide or polyetheretherketone melts.

17 Claims, 3 Drawing Sheets

LOUDSPEAKER DIAPHRAGM

REFERENCE TO EARLIER-FILED APPLICATION

This application claims priority to European Patent Application Serial No. 04291167.7 filed May 6, 2004, which application is incorporated, in its entirety, by reference in this application.

BACKGROUND OF THE INVENTION

1. Field of the Invention

The invention relates to a loudspeaker diaphragm and, specifically to a loudspeaker diaphragm in which a hybrid yarn is utilized in the manufacturing process.

2. Related Art

In a loudspeaker, the mechanical properties of the diaphragm play an important role in determining the sound quality of the loudspeaker. A problem in designing the loudspeaker diaphragm is that the material used for the loudspeaker diaphragm should be a material simultaneously having a low weight, a high stiffness, and good damping properties. The material should have a high relative elastic modulus $E/\rho$, where E is the elasticity and $\rho$ is the density of the diaphragm material. As an example, one possible material for loudspeaker diaphragms that is utilized in the art is aluminum.

Example approaches in the past include U.S. Pat. No. 6,097,829, dated Aug. 1, 2000, which discloses a composite loudspeaker diaphragm having first and second substantially flat carbon fibers and a honeycomb core sandwich between the first and second carbon skins. The sandwich diaphragm is manufactured so that the directions of the carbon fibers of the cross plies of each outer skin are out of phase relative to each other, preferably at a phase angle of approximately 90°. However, this approach does not solve the problem.

Another example approach includes Japan Patent No. 0 2170797-A related to a loudspeaker diaphragm in which a reinforcement fiber, such as carbon or glass, and an organic fiber, such as polyamide, are used. A polyolefin, modulated by introducing the carbo-oxylic acid functional group, is made to intervene between the reinforcement fiber and polypropylene. However, this approach also does not solve the problem.

Therefore, there is a need for further improving the mechanical properties of a loudspeaker diaphragm and to therefore find new materials or compositions that may be used in producing loudspeaker diaphragms, which materials or compositions are light-weight, have a high stiffness, and possess good damping properties.

SUMMARY OF THE INVENTION

A loudspeaker diaphragm having a matrix component and a reinforcement component is disclosed. The matrix component may include a polyamide, polyphenylene sulfide (PPS), or polyetheretherketone (PEEK) and the reinforcement component may include carbon or a para-aramid. The polyamide, PPS, or PEEK in the matrix component may be fibers arranged in a matrix, and carbon or para-aramid in the reinforcement component may be fiber.

Additionally, a method of making a loudspeaker diaphragm utilizing a fabric made from a hybrid yarn is also disclosed. The method may include preparing a fabric from a hybrid yarn, introducing the fabric into a mold, molding the fabric in the shape of the mold to form a loudspeaker diaphragm, heating the fabric to a temperature higher than the melting temperature of the fibers of the hybrid yarn, so that the fibers melt, and then cooling and solidifying the formed loudspeaker diaphragm.

Other systems, methods and features of the invention will be or will become apparent to one with skill in the art upon examination of the following detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of the preferred embodiment, reference is made to the accompanying drawings that form a part hereof, and which show, by way of illustration, a specific embodiment in which the invention may be practiced. Other embodiments may be utilized and structural changes may be made without departing from the scope of the present invention.

In general, the invention is a loudspeaker diaphragm that includes a composite material having a matrix component and a reinforcement component. The matrix component may include a first material such as a polyamide, polyphenylene sulfide (PPS), or polyetheretherketone (PEEK), and the reinforcement component may include a second material such as carbon or a para-aramid. The polyamide, PPS, PEEK in the matrix component may be fibers arranged in a matrix, and the carbon or para-aramid in the reinforcement component may be fiber.

Figure 1B:
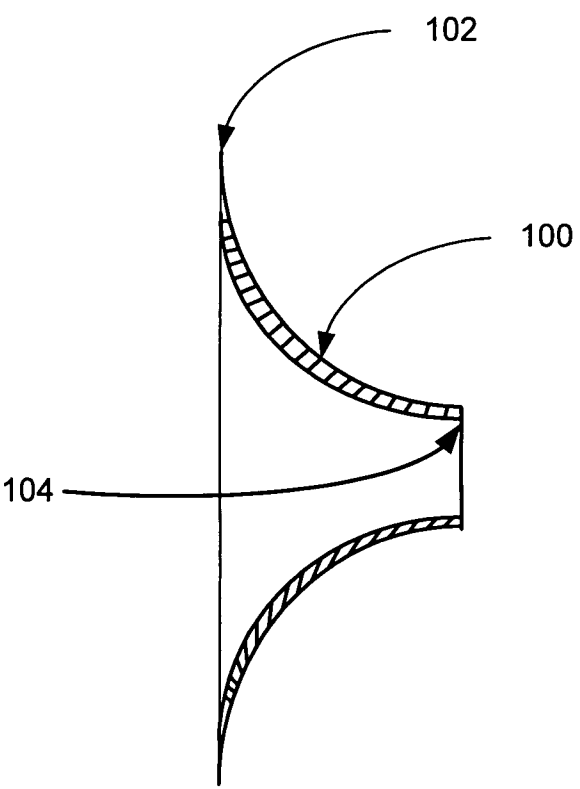
FIG. 1*b* is a sectional view of the loudspeaker diaphragm taken along line 1*b*-1*b* of FIG. 1*a*.
Figure 1A:
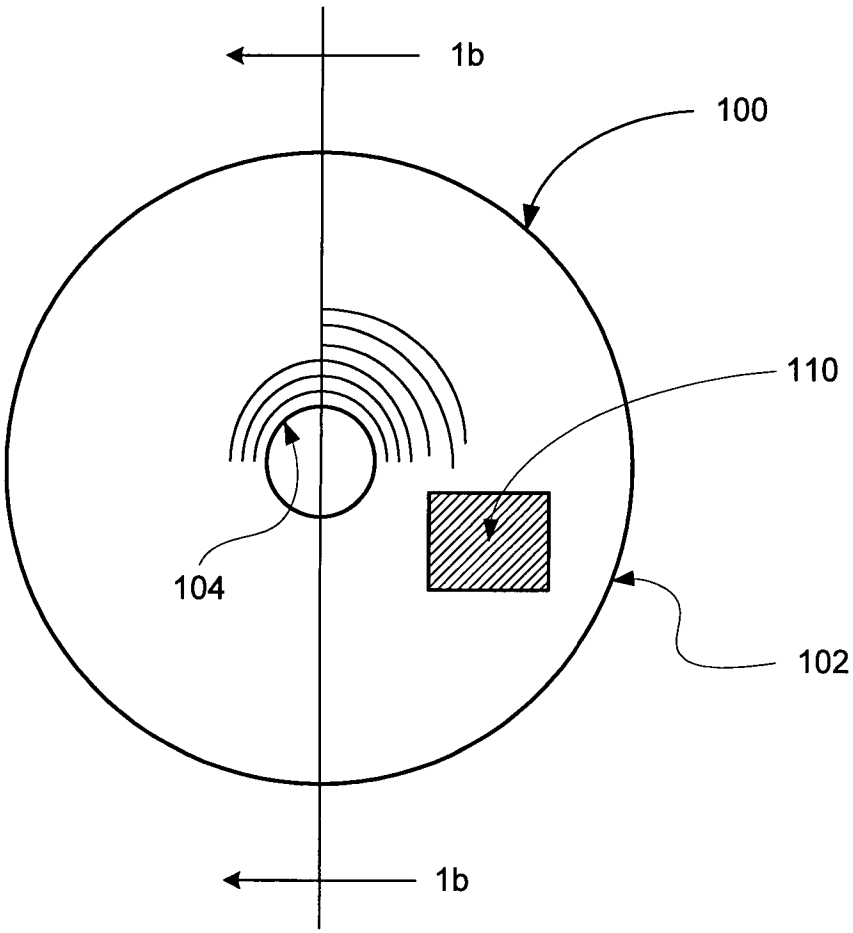
FIG. 1*a* is a front view of a loudspeaker diaphragm made in accordance with the invention.

FIG. 1*a* is a front view of a loudspeaker diaphragm 100, and FIG. 1*b* is a sectional view of a loudspeaker diaphragm 100 taken along line 1*b*-1*b* of FIG. 1*a*. The loudspeaker diaphragm 100 is defined by an outer circular perimeter 102 and an inner circular perimeter 104. Cross-sectional area 110 is a portion of the loudspeaker diaphragm 100 that is shown in more detail in FIGS. 2 and 3 to illustrate an example of an implementation of the hybrid yarn that makes up the loudspeaker diaphragm 100.

Figure 2:
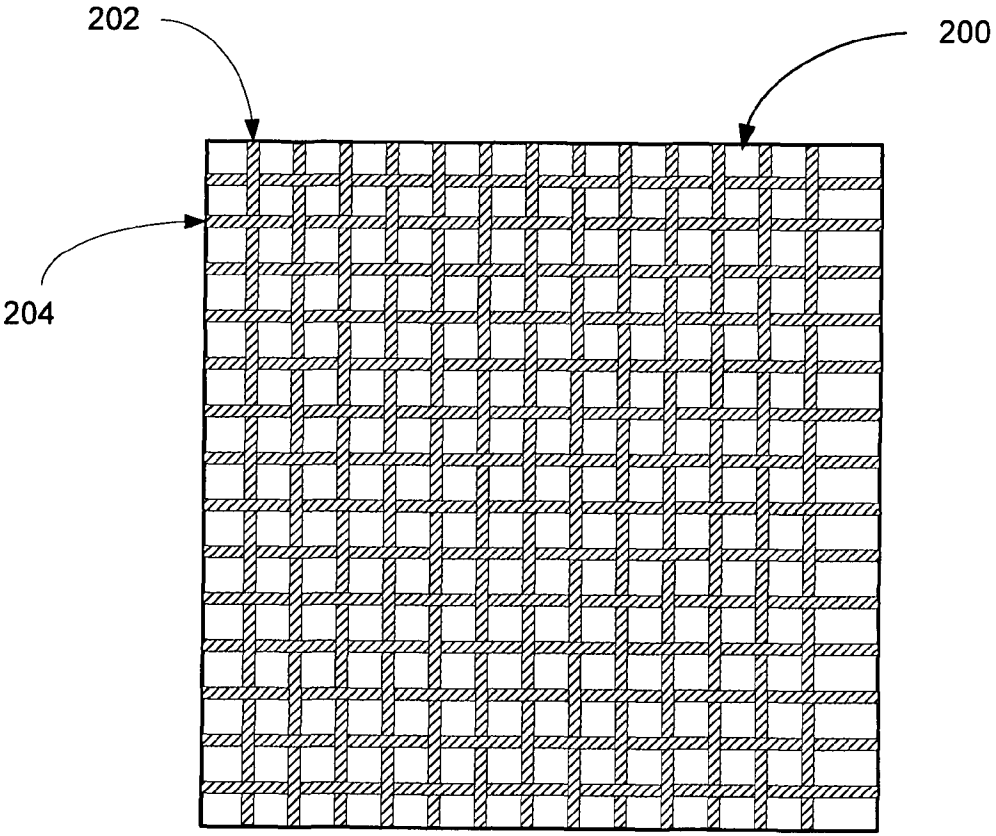
FIGS. 2 and 3 are more detailed views of a hybrid yarn that may be used in the loudspeaker diaphragm of FIGS. 1*a* and 1*b*.

FIG. 2 is an example of an implementation wherein the fabric may be prepared by an orthogonal arrangement of the hybrid yarns. In FIG. 2, the hybrid yarn 200 is conventionally weaved by passing one type of fiber over one of the other types of fiber and then under another. As an example, the vertical fibers 202 may be polyamide, PSA, or PEEK fibers, and the crossing fibers 204 may be carbon or para-aramid fibers that pass under one of the vertical fibers 202 then over the next. Other weave patterns may be utilized, e.g., passing over two then under two.

Figure 3:
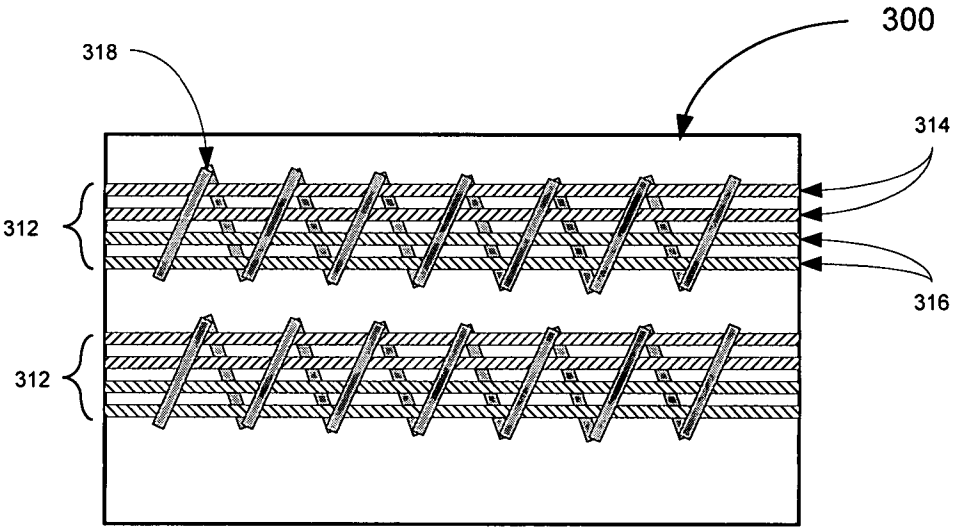

In another example of an implementation, the hybrid yarn used for the preparation of the fabric may be made by the parallel association of a plurality of carbon or para-aramid fibers together with a plurality of polyamide, PPS, or PEEK fibers. At least one polyamide, PPS, or PEEK fiber is wound around the parallel association of the fibers. Specifically, as an example, FIG. 3 illustrates two carbon fibers 314 arranged in parallel with two polyamide fibers 316 forming a hybrid fiber ensemble 312. In order to hold together these fibers, a wire 318 composed only of polyamide, PPS, or PEEK fiber may be wound around the hybrid fiber ensemble 312. The pattern is repeated to make the hybrid yarn 300. The implementation shown in FIG. 3 is for illustrative purposes and it is appreciated by those skilled in the art that other patterns and fibers may be utilized in preparing the hybrid yarn. Additionally, the hybrid fiber ensemble 312 bound by the wire 318 may be utilized in a weave such as that shown in FIG. 2.

With this arrangement of the hybrid yarn, a low void content may be obtained leading to a uniform distribution of the fibers of the reinforcement component and of the matrix component. According to another example of an implementation, a fabric utilized in the molding process may include 60 to 70% carbon by weight or 30 to 40% polyamide by weight, or may include 50 to 55% carbon by volume or 45 to 50% polyamide by volume, respectively. More specifically, a fabric may include 64 to 68% carbon by weight or 32 to 36% polyamide by weight. Additionally, a fabric may include 66% carbon by weight or 34% polyamide by weight, and 52% carbon by volume or 48% polyamide by volume, respectively.

In another example of an implementation of a loudspeaker diaphragm, the carbon or para-aramid element of the reinforcement component may be a fiber, and the polyamide, PPS, or PEEK element of the matrix component may be a matrix in which the fiber is arranged. In another example of an implementation, the polyamide may be polyamide 12 (PA 12). In another example of an implementation, the polyamide 12 may be used as a matrix component and the carbon reinforcement fibers may be arranged in the polyamide 12 matrix.

In another example of an implementation, the fibers of the reinforcement component may have a discontinuous structure. The fibers may have a length of between 40 mm and 200 mm, the diameter of the carbon reinforcement fibers may be approximately 6.8 microns, and the diameter of the para-aramid reinforcement fibers may be 12 microns.

Also disclosed is a method of making a loudspeaker diaphragm by a process in which a special hybrid yarn is used. For making a loudspeaker diaphragm, the following steps may be performed: First, a fabric is prepared from a hybrid yarn, wherein the hybrid yarn may include carbon or para-aramid fibers and polyamide, PPS, or PEEK fibers. The fabric may then be introduced into a mold where the fabric is molded to the form of a loudspeaker diaphragm. The molding step may also include the step of heating the fabric to a temperature higher than the melting temperature of the polyamide, PPS, PEEK fibers, as the case may be, so that the polyamide, PPS, PEEK fibers melt. The loudspeaker diaphragm may be cooled down and solidified. By using the hybrid yarn mentioned above and by using the above-mentioned fabrication steps, a loudspeaker diaphragm may be obtained that has superior mechanical properties, such as being light-weight, exhibiting a high stiffness, and possessing good damping properties.

With the use of 66% carbon by weight and 34% PA 12 by weight and 52% carbon by volume and 48% PA 12 by volume, a fabric may be obtained that, after being subjected to the above-described molding process, results in a tissue having good mechanical properties for use as a loudspeaker diaphragm. In an example of an implementation, the surface weight may be between 165 and 600 g/m$^2$, preferably between 400 and 550 g/m$^2$. With the above-mentioned composition, a surface weight of 520 g/m$^2$ may be obtained.

The density of the fabric produced from the hybrid yarn may be between 1.30 and 1.60 kg/dm$^3$, preferably between 1.38 and 1.42 kg/dm$^3$. When the above-mentioned composition of carbon and polyamide is used, a density of 1.41 kg/dm$^3$ may be obtained. When this density of 1.41 kg/dm$^3$ is compared to the density of aluminum $\rho$=2.7 kg/dm$^3$, it may be noted that this density is almost half that of the density of aluminum. This relatively low density $\rho$ helps to obtain a high relative elastic coefficient E/$\rho$, E being the elasticity of the loudspeaker diaphragm.

According to another example of an implementation, the fabric made from the hybrid yarn may have a thickness between 0.30 and 0.55 mm, preferably between 0.35 and 0.38 mm. One value of the thickness may be, e.g., 0.37 mm. According to an example of an implementation, the Young's modulus E of the loudspeaker diaphragm may be between 45 and 60 GPa, preferably 50 GPa. As can be seen from these elasticity values, the loudspeaker diaphragm produced by this method has a high stiffness, so that good damping properties are present. This elasticity is almost as high as that for aluminum, which has a Young's modulus E of 70 GPa. Thus, the relative elastic coefficient E/$\rho$ for the loudspeaker diaphragm made with the hybrid yarn may be higher than that for a loudspeaker diaphragm made with aluminum because the former almost has the same Young's modulus E as the latter, but has a density that is half as large as the density of the loudspeaker diaphragm made with aluminum.

The fabric is heated during the molding process, so as to melt the fibers in the matrix component. As an example, when polyamide 12 is used as matrix fiber, the loudspeaker diaphragm is heated to a temperature above 178° C. If polyphenylene sulfides are used as matrix fibers, the melting temperature is 285° C., so that the fabric is heated above this temperature. When PEEK fibers are used as the matrix fibers, the fabric is heated to a temperature of more than 334° C. Due to the arrangement of the two fibers in the hybrid yarn relative to each other, a low void content (e.g., <0.2%) may be obtained. For molding the fabric to the form of a loudspeaker diaphragm, different systems may be used, e.g., compression molding, bladder inflation molding, cold stamping, and diaphragm forming.

The heat that is used for the molding process may be obtained by using the Joule heating method or the induction heating method. The Joule heating method is a method wherein a current is passed through the fabric itself when it is electrically conductive. The circulating current and the electrical resistance of the material that is molded are responsible for the heating in the molding device. Another method of heating the material is the induction heating method. During induction heating, alternating magnetic fields are utilized to heat the fabric in the molding process by the heating of a conductive skin on each internal part of each part of the mold. As an example, a method of heating the material is disclosed in more detail in French Patent Application No. A-2816237.

As mentioned above, the hybrid yarn may be composed of carbon fibers and polyamide 12 fibers. According to another example of an implementation, the carbon fibers may be used together with PEEK. In this implementation, the fabric of the hybrid yarn may include 55 to 65% carbon by weight and 35 to 45% PEEK by weight, preferably 60% carbon by weight and 40% PEEK by weight, and includes 50 to 55% carbon by volume and 45 to 50% PEEK by volume, preferably 53% carbon by volume and 47% PEEK by volume.

According to another example of an implementation, the carbon fibers may be used together with PPS. In this implementation, the fabric made of the hybrid yarn may include 55 to 65% carbon by weight and 35 to 45% PPS by weight, preferably 60% carbon by weight and 40% PPS by weight, and includes 50 to 55% carbon by volume and 45 to 50% PPS by volume, preferably 53% carbon by volume and 47% PPS by volume.

It will be understood that the foregoing description of numerous implementations has been presented for purposes of illustration and description. It is not exhaustive and does not limit the claimed inventions to the precise forms disclosed. Modifications and variations are possible in light of the above description or may be acquired from practicing the invention. The claims and their equivalents define the scope of the invention.

What is claimed is:

1. A loudspeaker diaphragm comprising:

a matrix component having a first fiber material selected from a group consisting of
a polyamide,
a polyphenylene sulfide, and
a polyetheretherketone; and a reinforcement component having a second fiber material selected from a group consisting of
a carbon and
a para-aramid, wherein the matrix component and the reinforcement component form a fabric having a Young's modulus E between 45 and 60 GPa and a density between 1.30 and 1.60 kg/dm$^3$.

2. The loudspeaker diaphragm of claim 1, wherein the matrix component includes a matrix in which the second fiber material is arranged.

3. The loudspeaker diaphragm of claim 1, wherein fibers of the reinforcement component have a discontinuous structure, and the length of the fibers are between 20 and 44 mm.

4. The loudspeaker diaphragm of claim 3, wherein the diameter of the carbon reinforcement fibers is approximately 6.8 microns, and the diameter of the para-aramid reinforcement fibers is approximately 12.0 microns.

5. The loudspeaker diaphragm of claim 1, wherein the polyamide includes polyamide 12.

6. The loudspeaker diaphragm of claim 1, wherein respective fibers of the matrix component and the reinforcement component are orthogonal to each other.

7. The loudspeaker diaphragm of claim 1, wherein the arrangement includes a parallel association of a plurality of first fiber material fibers together with a plurality of second fiber material fibers, with at least one other second fiber material fiber being wound around the parallel association of fibers.

8. The loudspeaker diaphragm of claim 1, wherein the reinforcement component includes 60 to 70% carbon by weight and 50 to 55% carbon by volume, and the matrix component includes 30 to 40% polyamide by weight and 45 to 50% polyamide by volume.

9. The loudspeaker diaphragm of claim 1, wherein the reinforcement component includes 55 to 65% carbon by weight and 50 to 55% carbon by volume, and the matrix component includes 35 to 45% polyetheretherketone by weight and 45 to 50% polyetheretherketone by volume.

10. The loudspeaker diaphragm of claim 1, wherein the reinforcement component includes 55 to 65% carbon by weight and 50 to 55% carbon by volume, and the matrix component includes 35 to 45% polyphenylene sulfide by weight and 45 to 50% polyphenylene sulfide by volume.

11. The loudspeaker diaphragm of claim 1, wherein the Young's modulus E is 50 GPa.

12. The loudspeaker diaphragm of claim 1, wherein the density ranges between 1.38 and 1.42 kg/dm$^3$.

13. The loudspeaker diaphragm of claim 1, wherein the density is 1.41 kg/dm$^3$.

14. The loudspeaker diaphragm of claim 1, wherein the fabric has a surface weight between 165 and 600 g/m$^2$.

15. The loudspeaker diaphragm of claim 1, wherein the fabric has a surface weight between 400 and 550 g/m$^2$.

16. The loudspeaker diaphragm of claim 1, wherein the fabric has a surface weight of 520 g/m$^2$.

17. The loudspeaker diaphragm of claim 1, wherein the fabric has a void content of less than 0.2%.

* * * * *